US006997632B1

(12) United States Patent
Adams

(10) Patent No.: US 6,997,632 B1
(45) Date of Patent: Feb. 14, 2006

(54) SHOWER BODY BRUSH SYSTEM

(76) Inventor: Gabe Adams, 1595 Cherokee Rd., Corona, CA (US) 92881

( * ) Notice: Subject to any disclaimer, the term of this patent is extended or adjusted under 35 U.S.C. 154(b) by 0 days.

(21) Appl. No.: 11/078,466

(22) Filed: Mar. 11, 2005

(51) Int. Cl.
*A46B 11/06* (2006.01)

(52) U.S. Cl. ..... 401/289; 401/291; 401/270

(58) Field of Classification Search ..... 401/289, 401/270, 290, 291; 4/606, 615; 239/525–532; 15/205.2, 159.1
See application file for complete search history.

(56) References Cited

U.S. PATENT DOCUMENTS 352,009 A * 11/1886 Seery ..... 401/289
1,639,586 A * 8/1927 Boucher ..... 401/28
2,748,411 A * 6/1956 O'Brien ..... 401/15
3,453,059 A * 7/1969 Noble ..... 401/289
3,782,837 A * 1/1974 Feldmann ..... 401/281
5,033,897 A * 7/1991 Chen ..... 401/281

* cited by examiner

*Primary Examiner*—David J. Walczak
(74) *Attorney, Agent, or Firm*—Edward P. Dutkiewicz

(57) ABSTRACT

A head has an open flat circular front face, a rearwardly extending housing in a generally hemispherical configuration with a downwardly extending handle, a front face having a central opening and a circular lip. A water handling assembly includes an annular manifold supported by the circular lip. The water handling assembly has a front plate with a plurality of orifices and a rear plate. The water handling assembly also includes a cylindrical pipe located within the handle. An insert in an annular shape has forwardly extending bristles and rearwardly extending rings. The rings are adapted to span the lip of the housing for simple attaching and detaching whereby a user may utilize bristles of a desired flexibility.

2 Claims, 3 Drawing Sheets

SHOWER BODY BRUSH SYSTEM

BACKGROUND OF THE INVENTION

1. Field of the Invention

The present invention relates to a shower body brush system and more particularly pertains to providing a bather with a brushing and a simultaneous shower massage with variable pressure.

2. Description of the Prior Art

The use of massagers of known designs and configurations is known in the prior art. More specifically, massagers of known designs and configurations previously devised and utilized for the purpose of massaging a user through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,026,981 issued Jan. 7, 1936 to Kahnt relates to a massaging and bathing apparatus. U.S. Pat. No. 3,910,265 issued Oct. 7, 1975 to Coleman relates to a hygienic device. U.S. Pat. No. 3,963,179 issued Jun. 15, 1976 to Tomaro relates to a shower head adapted to produce steady or pulsating flows. Lastly, U.S. Pat. No. 6,306,110 issued Oct. 23, 2001 to McElhannon relates to a water powered massager.

While these devices fulfill their respective, particular objectives and requirements, the aforementioned patents do not describe shower body brush system that allows providing a bather with a brushing and a simultaneous shower massage with variable pressure.

In this respect, the shower body brush system according to the present invention substantially departs from the conventional concepts and designs of the prior art, and in doing so provides an apparatus primarily developed for the purpose of providing a bather with a brushing and a simultaneous shower massage with variable pressure.

Therefore, it can be appreciated that there exists a continuing need for a new and improved shower body brush system which can be used for providing a bather with a brushing and a simultaneous shower massage with variable pressure. In this regard, the present invention substantially fulfills this need.

SUMMARY OF THE INVENTION

In view of the foregoing disadvantages inherent in the known types of massagers of known designs and configurations now present in the prior art, the present invention provides an improved shower body brush system. As such, the general purpose of the present invention, which will be described subsequently in greater detail, is to provide a new and improved shower body brush system and method which has all the advantages of the prior art and none of the disadvantages.

To attain this, the present invention essentially comprises a head. The head has an open flat circular front face. The head has a rearwardly extending housing. The housing is in a generally hemispherical configuration. A downwardly extending handle is provided. The handle is for being held by a bather during operation and use. The front face has a central opening. A circular lip is provided around the central opening. The head is fabricated of a rigid material, preferably plastic.

A water handling assembly is provided. The water handling assembly includes an annular manifold. The annual manifold is supported by the circular lip within the housing in proximity to the front face of the head. The manifold has a front plate. The front plate has a plurality of orifices. The orifices are provided in circles. The orifices are spaced from the center of the front plate for spraying water onto a bather. The manifold has a rear plate. The rear plate has an opening. In this manner water to be sprayed through the orifices may be received. The water handling assembly also includes a cylindrical pipe. The cylindrical pipe is located within the handle. The cylindrical pipe extends to the opening of the rear plate.

Provided next is a valve assembly. The valve assembly includes a circular flapper. The circular flapper is pivotally mounted within the pipe adjacent to the handle. The valve assembly also includes an extender rod. The extender rod has an exterior end. The exterior end extends through the front face of the manifold. The extender rod has an interior end. The interior end is coupled to the circular flapper through its diameter. The valve assembly also includes an adjuster. The adjuster is provided in a cylindrical configuration. The adjuster is attached to the exterior end of the rod in bearing contact with the front face of the manifold. In this manner a user may selectively rotate the adjuster to rotate the flapper to increase and decrease the quantity of water flowing through the orifices as well as its pressure.

Further provided is an insert. The insert is provided in an annular shape. The insert has forwardly extending bristles. The bristles are provided in two concentric rows. Rearwardly extending rings are provided. The rings are adapted to span the lip of the housing for simple attaching and detaching. In this manner a user may utilize bristles of a desired flexibility. The insert has a central opening for the spraying of water there through. The insert is fabricated of a semi rigid elastomeric material, preferably plastic or rubber, natural or synthetic, or natural and synthetic blends.

Provided last is a flexible tube. The flexible tube has a water input end. The water input end is adapted to removably couple to a shower for constituting a supply of water to be sprayed. The tube also has an output end. The output end is adapted to be removably coupled to the pipe in the handle remote from the housing. In this manner a bather may spray water while bathing. The spray is adjustable by a user rotating the adjuster and simultaneously brush if desired to a predetermined pressure from the bristles for cleanliness and pleasurable sensations. The brushing is independent of the spraying if desired. The spraying being independent of the brushing if desired.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shower body brush system which has all of the advantages of the prior art massagers of known designs and configurations and none of the disadvantages.

It is another object of the present invention to provide a new and improved shower body brush system which may be easily and efficiently manufactured and marketed.

It is further object of the present invention to provide a new and improved shower body brush system which is of durable and reliable constructions.

An even further object of the present invention is to provide a new and improved shower body brush system which is susceptible of a low cost of manufacture with regard to both materials and labor, and which accordingly is then susceptible of low prices of sale to the consuming public, thereby making such shower body brush system economically available to the buying public.

Even still another object of the present invention is to provide a shower body brush system for providing a bather with a brushing and a simultaneous shower massage with variable pressure.

Lastly, it is an object of the present invention to provide a new and improved shower body brush system. A head has an open flat circular front face, a rearwardly extending housing in a generally hemispherical configuration with a downwardly extending handle, a front face having a central opening and a circular lip. A water handling assembly includes an annular manifold supported by the circular lip. The water handling assembly has a front plate with a plurality of orifices and a rear plate. The water handling assembly also includes a cylindrical pipe located within the handle. An insert in an annular shape has forwardly extending bristles and rearwardly extending rings. The rings are adapted to span the lip of the housing for simple attaching and detaching whereby a user may utilize bristles of a desired flexibility.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
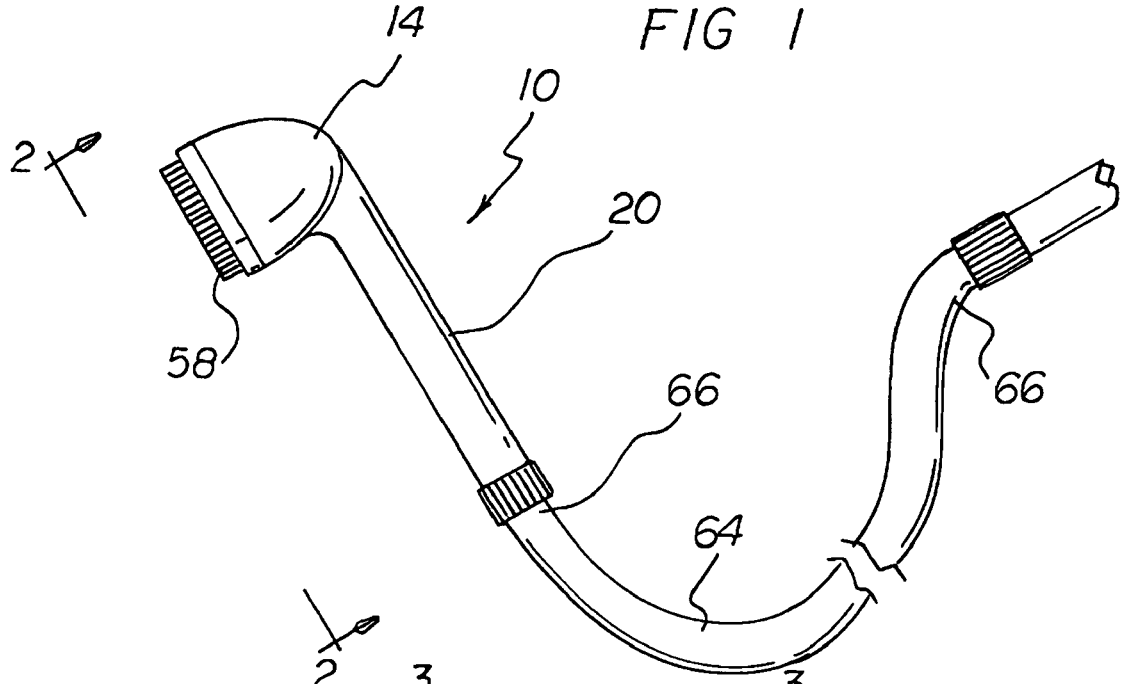
FIG. 1 is a side elevational view of a shower body brush system constructed in accordance with the principles of the present invention.
Figure 2:
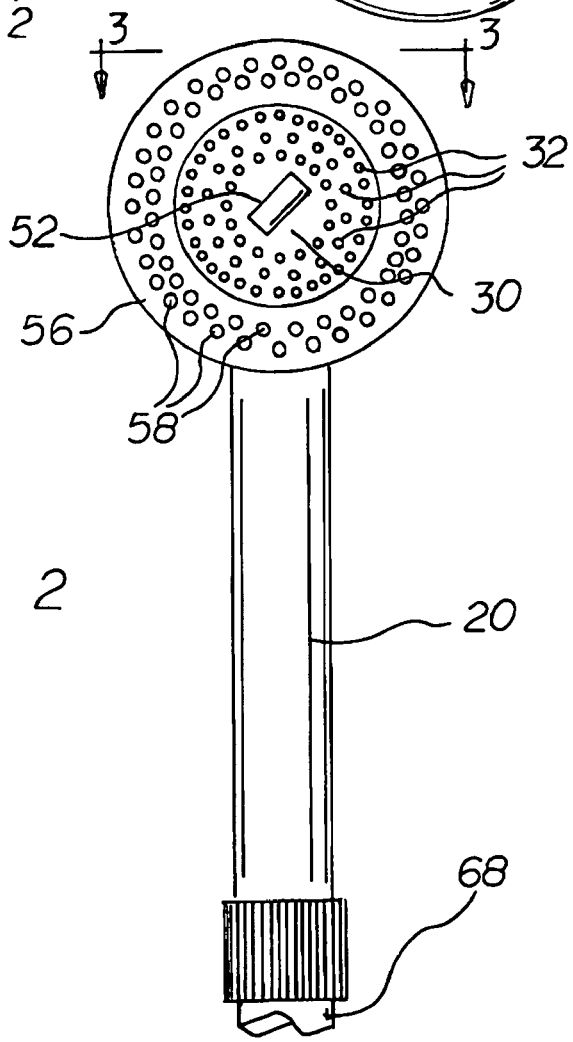
FIG. 2 is a front elevational view of the head of the system taken along line 2—2 of FIG. 1.
Figure 3:
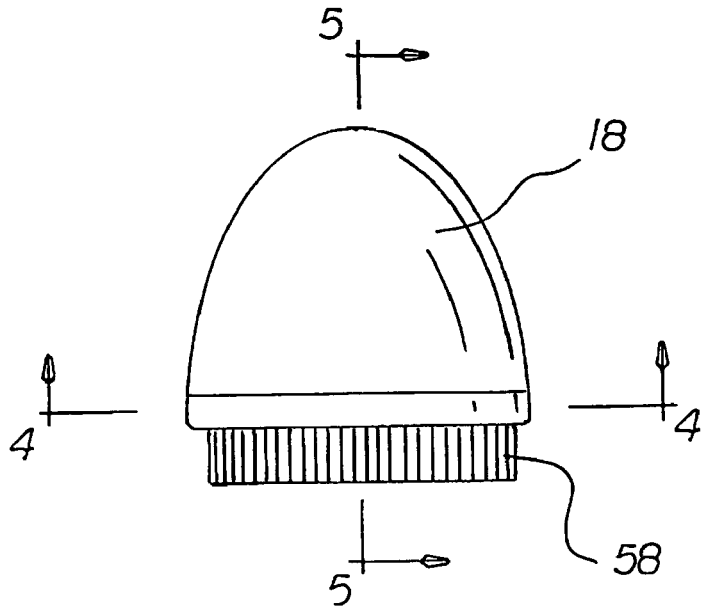
FIG. 3 is a plan view of the head of the system taken along line 3—3 of FIG. 2.
Figure 4:
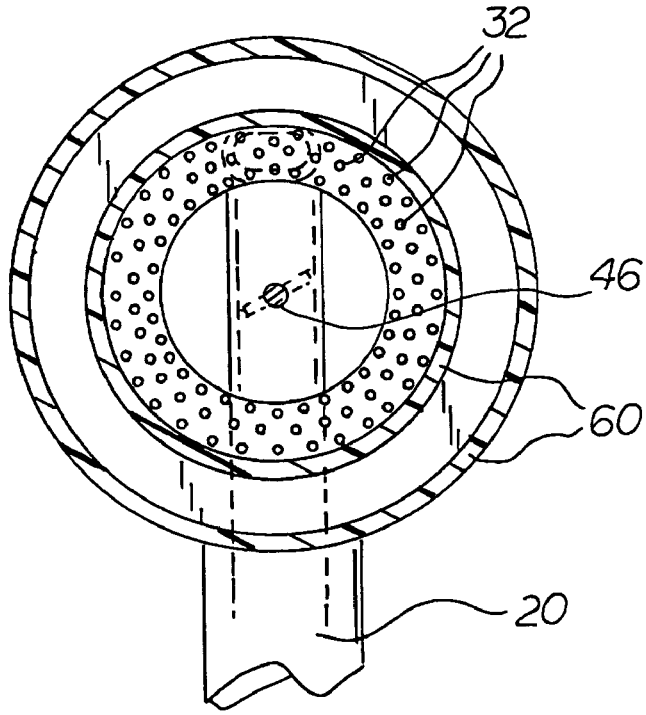
FIG. 4 is a cross sectional; view of the head taken along line 4—4 of FIG. 3.

With reference now to the drawings, and in particular to FIG. 1 thereof, the preferred embodiment of the new and improved shower body brush system embodying the principles and concepts of the present invention and generally designated by the reference numeral 10 will be described.

The present invention, the shower body brush system 10 is comprised of a plurality of components. Such components in their broadest context include a head, a water handling assembly, and an insert. Such components are individually configured and correlated with respect to each other so as to attain the desired objective.

First provided is a head 14. The head has an open flat circular front face 16. The head has a rearwardly extending housing 18. The housing is in a generally hemispherical configuration. A downwardly extending handle 20 is provided. The handle is for being held by a bather during operation and use. The front face has a central opening. A circular lip 22 is provided around the central opening. The head is fabricated of a rigid material, preferably plastic.

A water handling assembly 26 is provided. The water handling assembly includes an annular manifold 28. The annual manifold is supported by the circular lip within the housing in proximity to the front face of the head. The manifold has a front plate 30. The front plate has a plurality of orifices 32. The orifices are provided in circles. The orifices are spaced from the center of the front plate for spraying water onto a bather. The manifold has a rear plate 34. The rear plate has an opening 36. In this manner water to be sprayed through the orifices may be received. The water handling assembly also includes a cylindrical pipe 38. The cylindrical pipe is located within the handle. The cylindrical pipe extends to the opening of the rear plate.

Provided next is a valve assembly 42. The valve assembly includes a circular flapper 44. The circular flapper is pivotally mounted within the pipe adjacent to the handle. The valve assembly also includes an extender rod 46. The extender rod has an exterior end 48. The exterior end extends through the front face of the manifold. The extender rod has an interior end 50. The interior end is coupled to the circular flapper through its diameter. The valve assembly also includes an adjuster 52. The adjuster is provided in a cylindrical configuration. The adjuster is attached to the exterior end of the rod in bearing contact with the front face of the manifold. In this manner a user may selectively rotate the adjuster to rotate the flapper to increase and decrease the quantity of water flowing through the orifices as well as its pressure. The adjuster is shown as a short member rotatable at its center located on the front of the system. It should be appreciated that the adjuster, in alternate embodiments, takes any of a plurality of sizes and shapes and is operable by a user from any of a plurality of locations.

Further provided is an insert 56. The insert is provided in an annular shape. The insert has forwardly extending bristles 58. The bristles are provided in two concentric rows. Rearwardly extending rings 60 are provided. The rings are adapted to span the lip of the housing for simple attaching and detaching. In this manner a user may utilize bristles of a desired flexibility. The insert has a central opening for the spraying of water there through. The insert is fabricated of a semi rigid elastomeric material, preferably plastic or rubber, natural or synthetic, or natural and synthetic blends.

Provided last is a flexible tube 64. The flexible tube has a water input end 66. The water input end is adapted to removably couple to a shower for constituting a supply of water to be sprayed. The tube also has an output end 68. The output end is adapted to be removably coupled to the pipe in the handle remote from the housing. In this manner a bather may spray water while bathing. The spray is adjustable by a user rotating the adjuster and simultaneously brushed if desired to a predetermined pressure from the bristles for cleanliness and pleasurable sensations. The brushing is independent of the spraying if desired. The spraying being independent of the brushing if desired.

In the disclosed preferred embodiment, the orifices are in a circular configuration about a center point while the bristles are in a circular configuration outwardly of the orifices and the center point. In alternate embodiments, the orifices and/or the bristles are in a non-circular configuration such as an oval configuration.

Figure 5:
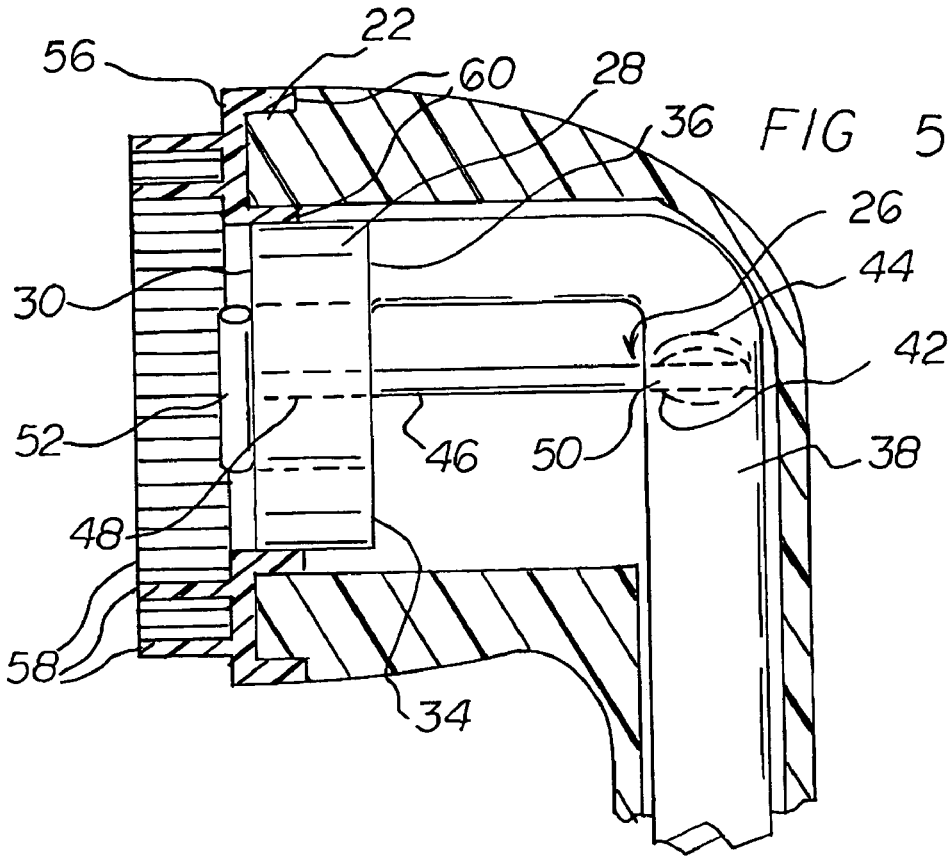
FIG. 5 is a cross sectional; view of the head taken along line 5—5 of FIG. 3.
Figure 6:
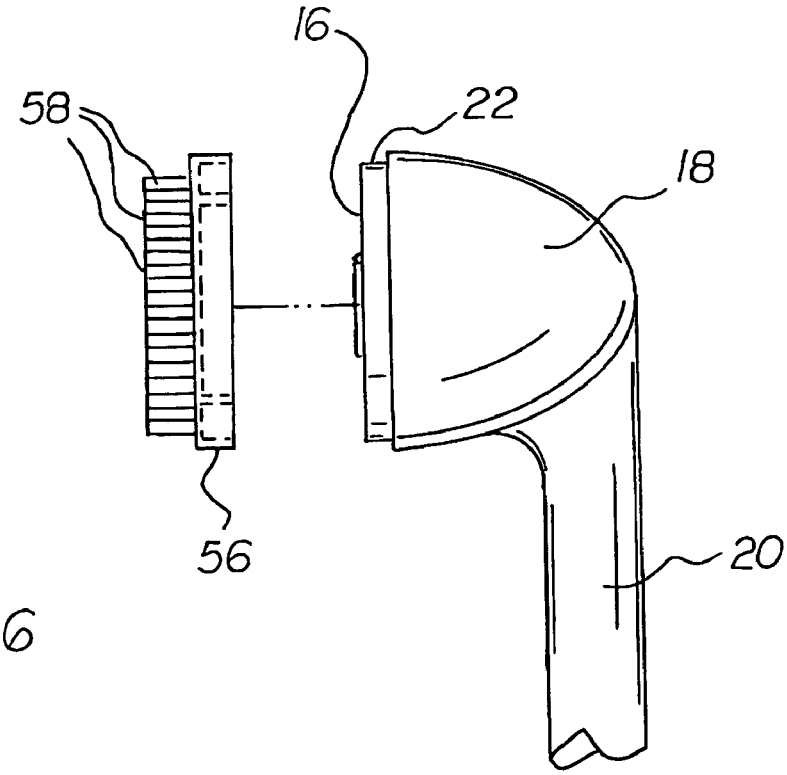
FIG. 6 is an enlarged exploded side elevational view of the head of the system as seen in FIG. 1.

An additional feature may be seen in FIG. 5. Such feature is a water pulsing mechanism in the path of flow of the water in proximity to the location where the water leaves the system. When activated, a user may brush while being simultaneously massaged with pulsating water.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shower body brush system for providing a bather with a brushing and a simultaneous shower massage with variable pressure comprising, in combination:

a head having an open flat circular front face and a rearwardly extending housing in a generally hemispherical configuration with a downwardly extending handle for being held by a bather during operation and use, the front face having a central opening and a circular lip there around;

a water handling assembly including an annular manifold within the housing in proximity to the front face of the head, the manifold having a front plate with a plurality of orifices in circles spaced from the center of the front plate for spraying water onto a bather, the manifold having a rear plate with an opening for receiving water to be sprayed through the orifices, the water handling assembly also including a cylindrical pipe located within the handle and extending to the opening of the rear plate;

a valve assembly including a circular flapper pivotally mounted within the pipe adjacent to the handle, the valve assembly also including an extender rod having an exterior end extending through the front face of the manifold and an interior end coupled to the circular flapper through its diameter, the valve assembly also including an adjuster in a cylindrical configuration attached to the exterior end of the rod in bearing contact with the front face of the manifold whereby a user may selectively rotate the adjuster to rotate the flapper to increase and decrease the quantity of water flowing through the orifices as well as its pressure;

an insert in an annular shape with forwardly extending bristles in two concentric rows and with rearwardly extending rings adapted to span the lip of the housing for simple attaching and detaching whereby a user may utilize bristles of a desired flexibility, the insert having a central opening for the spraying of water there through; and a flexible tube having a water input end adapted to removably couple to a shower for constituting a supply of water to be sprayed, the tube also having an output end adapted to be removably coupled the pipe in the handle remote from the housing whereby a bather may spray water while bathing, the spray being adjustable by a user rotating the adjuster and brushed if desired to a predetermined pressure by the user from the bristles for cleanliness and pleasurable sensations.

2. A shower body brush system comprising:

a head having an open flat circular front face and a rearwardly extending housing in a generally hemispherical configuration with a downwardly extending handle, the front face having a central opening and a circular lip there around;

a water handling assembly including an annular manifold within the housing and having a front plate with a plurality of orifices and a rear plate, the water handling assembly also including a cylindrical pipe located within the handle;

an insert in an annular shape with forwardly extending bristles and with rearwardly extending rings adapted to span the lip of the housing for simple attaching and detaching whereby may utilize bristles of a desired flexibility; and a valve assembly including a circular flapper pivotally mounted within the pipe adjacent to the handle, the valve assembly also including an extender rod having an exterior end extending through the front face of the manifold and an interior end coupled to the circular flapper through its diameter, the valve assembly also including an adjuster in a cylindrical configuration attached to the exterior end of the rod in bearing contact with the front face of the manifold whereby a user may selectively rotate the adjuster to rotate the flapper to increase and decrease the quantity of water flowing through the orifices as well as its pressure.

* * * * *